US005635655A

United States Patent [19]

Yamashita

[11] Patent Number: 5,635,655

[45] Date of Patent: Jun. 3, 1997

[54] APPARATUS, WITH OIL DAMPER, FOR OPENING AND CLOSING FALL BOARD OF MUSICAL KEYBOARD INSTRUMENT

[75] Inventor: Mitsuo Yamashita, Hamamatsu, Japan

[73] Assignee: Kabushiki Kaisha Kawai Gakki Seisakusho, Hamamatsu, Japan

[21] Appl. No.: 507,294

[22] PCT Filed: Jan. 20, 1995

[86] PCT No.: PCT/JP95/00064

§ 371 Date: Aug. 24, 1995

§ 102(e) Date: Aug. 24, 1995

[87] PCT Pub. No.: WO95/20211

PCT Pub. Date: Jul. 27, 1995

[30] Foreign Application Priority Data

Jan. 21, 1994 [JP] Japan ..... 6-005401

[51] Int. Cl.[6] ..... G10C 3/02

[52] U.S. Cl. ..... 84/179; 84/423 R; 312/295; 220/334

[58] Field of Search ..... 84/179, 178, 423 R; 312/295, 291, 292, 293.2; 220/335, 334; 49/254

[56] References Cited

U.S. PATENT DOCUMENTS

| | | | |
|---|---|---|---|
| 4,641,565 | 2/1987 | Tachida et al. | 84/179 |
| 5,056,396 | 10/1991 | Furukawa | 84/179 |
| 5,067,625 | 11/1991 | Numata | 220/334 |

FOREIGN PATENT DOCUMENTS 63-177895 11/1988 Japan .

*Primary Examiner*—Cassandra C. Spyrou
*Attorney, Agent, or Firm*—Armstrong, Westerman, Hattori, McLeland & Naughton

[57] ABSTRACT

An apparatus, with an oil damper for damping the closing of a fall board on a main body of a musical keyboard and permits opening of such keyboard without damping when the fall board is opened. The oil damper has a body with a cylindrical chamber, having a stop projecting radially inward, such body being fixed to said fall board. A pivotal member in the chamber having a shaft and a projecting portion on said shaft in said chamber, such shaft extending outwardly from such chamber and through a liquid tight seal at one end of the chamber, the outwardly extending shaft being fixed to the main body. A movable arcuate valve in the cylindrical chamber and slidable on an inner wall of the chamber, such valve having radial portions extending inward toward such shaft and at opposite sides of the projecting portion of the pivotal member. Fluid passages in such projecting portion of the pivotal member and each of the valve radial portions, the fluid passage in the radial valve portion at one opposite of the projecting portion being smaller than the fluid passage at the other side so that the fall board, when the projecting portion of the pivotal member is rotated toward the smaller of the fluid passages to close the fall board, is dampened and when rotated in the opposite direction to open the fall board is rotated without dampening.

1 Claim, 2 Drawing Sheets

APPARATUS, WITH OIL DAMPER, FOR OPENING AND CLOSING FALL BOARD OF MUSICAL KEYBOARD INSTRUMENT

DESCRIPTION

1. Technical Field

The present invention relates to an apparatus, with an oil damper, for opening and closing a fall board of a musical keyboard instrument.

2. Background Art

As a conventional apparatus for opening and closing a fall board of a musical keyboard instrument, there are known some in which a damping function is generated and the fall board rotates gently when it is rotated in a direction to close it so that a shock to be applied to fingers, etc. may be alleviated even if the fingers, etc. were to be pinched between the fall board and the musical instrument main body by inadvertently letting a fall board to fall. One such apparatus uses a spring damper having wound a coil spring around a rotation shaft, and another apparatus uses an oil damper.

DISCLOSURE OF INVENTION

With the above-mentioned apparatus using the spring damper, there are disadvantages in that, even in a condition in which the fall board is closed, the fall board is slightly lifted due to the elastic force of the spring and is therefore not tightly closed. Thus it is difficult to stabilize the quality by controlling the spring constants. With the above-mentioned apparatus, using the oil damper, there are disadvantages in that, because the damper is large in size, it is embedded in the musical instrument main body. Therefore the musical instrument main bodies cannot economically be used in common with the musical instrument main bodies provided with fall boards requiring no damper function. Thus, the cost cannot be reduced.

The present invention has an object of solving disadvantages of the conventional apparatuses.

In order to attain the above-mentioned object, the present invention is characterized in: that an oil damper is provided in a fall board so that the fall board is rotatably supported on a musical instrument main body by the oil damper. Such oil damper creates a damping function when the fall board rotates in a direction in which it is closed.

Further, the present invention is characterized in that, in an apparatus for opening and closing a fall board of a musical keyboard instrument in which an oil damper is provided in the fall board so that the fall board is rotatably supported on a musical instrument main body by the oil damper and in which the oil damper creates a damping function when the fall board rotates in a direction in which it is closed, the oil damper comprises: a casing filled inside a hollow cylindrical chamber thereof with a viscous fluid, the casing being closed at one axial end portion thereof and open at the other end portion thereof; a pivoting member, assembled so as to be rotatable relative to the casing and which, in a center thereof a shaft portion to be disposed inside the chamber so as to be rotatable about an axis of the casing; a movable valve which is engaged, with play in the direction of rotation, with a projecting portion provided in an axially extending manner along a peripheral surface of the shaft, one side or the other side of which contacts the projecting portion, depending on the direction of rotation of the casing; fluid passages in one side and the other side, as well as in a contact portion of the projecting portion of the movable valve, such that the viscous fluid passes through the movable valve with different resistances, depending on the direction of rotation of the casing; and sealing means between the casing and the pivoting member so as to seal the viscous fluid; the fluid passages are arranged by fixing the casing to the fall board and engaging the pivoting member with a bearing member in the musical instrument main body such that a high resistance occurs to the passing fluid when the fall board is rotated in the direction to close it and a low resistance occur when the fall board is rotated in the direction to open it.

According to the above-mentioned arrangement, the present invention has the effects that the cost becomes low because the musical instrument main body can be used in common with the musical instrument main body provided with a fall board using no oil damper, the fall board tightly closes in a closed condition, and is easy to stabilize the quality.

BEST MODE FOR CARRYING OUT THE INVENTION

An explanation will now be made about an embodiment of the present invention with reference to the accompanying drawings.

Figure 1:
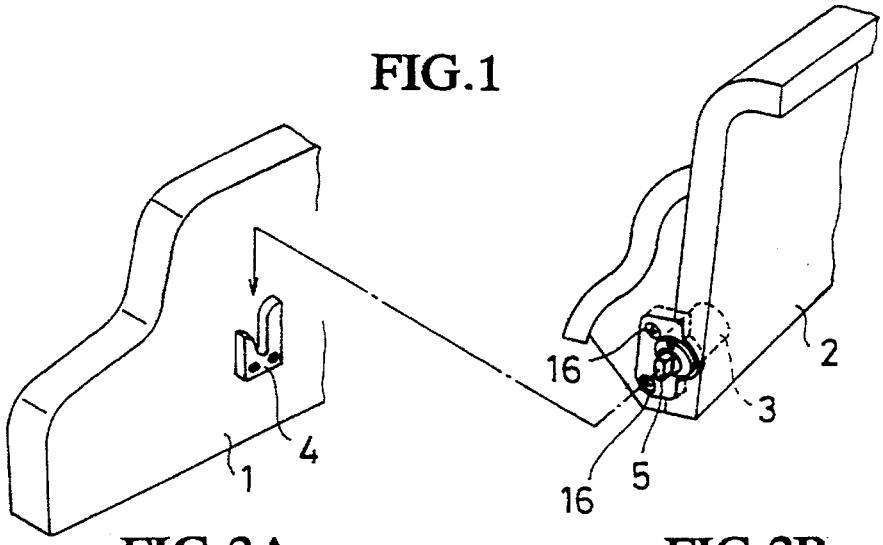
FIG. 1 is an exploded perspective view of an important portion of an embodying example of the present invention.

In FIG. 1 numeral 1 denotes an arm of a musical instrument main body and numeral 2 denotes a fall board.

Figure 2A:
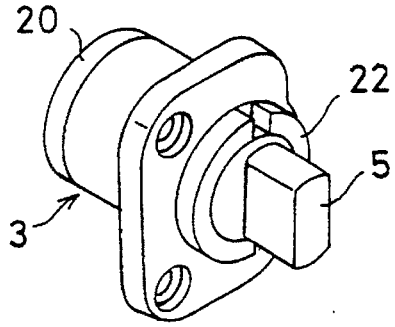
FIGS. 2A, 2B and 2C are a perspective view, a sectional view, and an exploded perspective view, respectively, of an oil damper used in the above-mentioned embodying example.
Figure 2B:
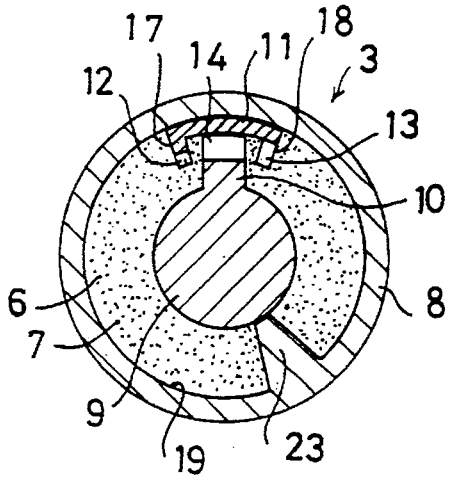
Figure 2C:
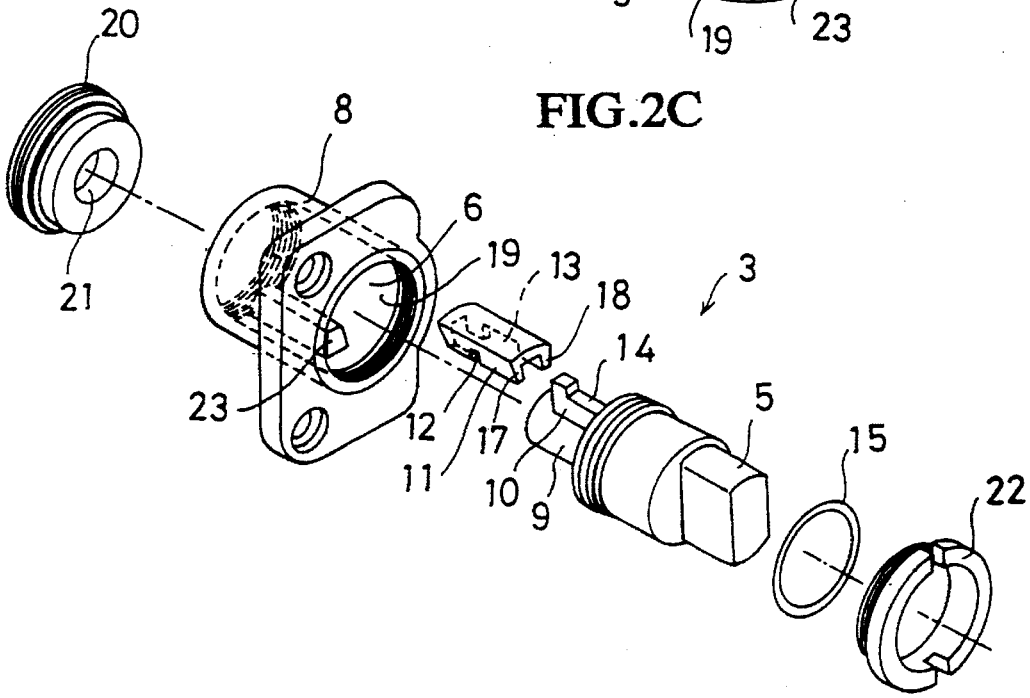

On both side portions of the fall board 2 there is respectively embedded an oil damper 3. On an internal wall surface of the arm 1 on each side there is provided a U-shaped bearing member 4. By engaging a pivoting member 5 of the oil damper 3 with a groove of the bearing member 4, the fall board 2 is rotatably mounted on the arm 1. As shown in FIGS. 2A through 2C, the oil damper 3 is made up of a casing 8 which can be filled inside a hollow cylindrical chamber 6 thereof which is closed at one axial end portion and is open at the other end portion, with a viscous fluid; the pivoting member 5 is assembled so as to be rotatable relative to the casing 8 and has a shaft portion 9 disposed inside the above-mentioned chamber 6 so as to be rotatable about an axis of the casing 8; a movable arcuate valve 11 is engaged, with a play in the direction of rotation, with a projecting portion 10 provided in an axially extending manner along a peripheral surface of the above-mentioned shaft 9, one side or the other side of the movable valve contacting the above-mentioned projecting portion 10 depending on the direction of rotation of the casing 8; fluid passages 12 and 13, as well as 14, are, respectively, formed in one side and the other side of the above-mentioned movable valve 11 as well as in a contact portion of the projecting portion 10 such that the viscous fluid 7 can pass through the movable valve 11, with different resistances, depending on the direction of relative rotation between the casing 8 and the pivoting member 5; and a sealing means 15 comprising, for example, an O-ring which is provided between the casing 8 and the pivoting member 5 so as to seal the viscous fluid 7. The above-mentioned casing 8 is mounted on the fall board 2 with screws 16, 16 as shown in FIG. 1. In more detail, the above-mentioned movable valve 11 is formed substantially into a channel-shaped cross section. The distance between substantially perpendicular walls 17, 18 on both sides as seen in the direction of rotation is larger than the width, as seen in the direction of rotation, of the projecting portion 10. It has a play in the direction of rotation and is seated onto the projecting portion 10 and slidingly abuts the internal wall surface 19 of the casing 8. The above-mentioned fluid passages 12 and 13 are formed in both the substantially perpendicular walls 17, 18 of the movable valve 11, and the fluid passage 14 is formed by partly cutting the projecting portion 10. The fluid passage 12 in the direction of rotation to generate a high resistance is formed in a small cross section, and the fluid passage 13 in the opposite direction of rotation to generate a low resistance is formed in a cross section which is larger than the former.

In FIGS. 2A and 2C, numeral 20 denotes a closing cap which closes one end of the chamber 6 by being threaded into one end of the casing 8 and which has in its center a recessed portion 21 for fitting thereinto the end of shaft portion 9 at one end of the pivoted member 5. Numeral 22 denotes a bearing member which is threaded into an opening on the other end of the casing 8 for rotatably receiving the other end of the pivoting member 5. Numeral 23 denotes an axially extending stopper which is provided on an internal wall 19 of casing 8.

Figure 3A:
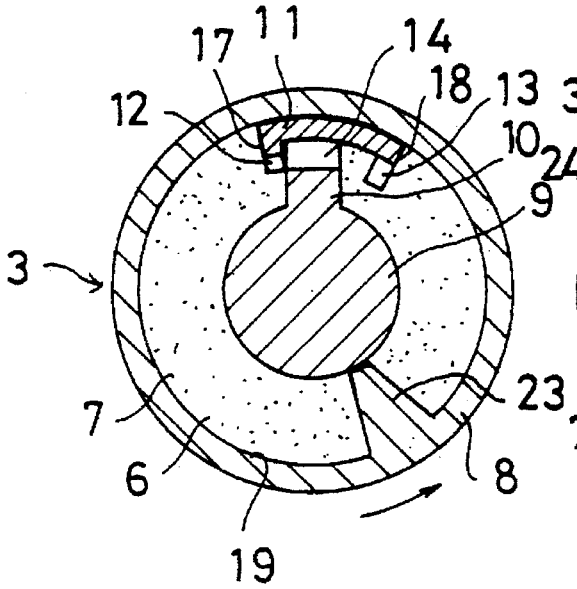
FIGS. 3A, 3B, 3C and 3D are explanation diagrams to explain the operation of the oil damper when a fall board is opened or closed.
Figure 3B:
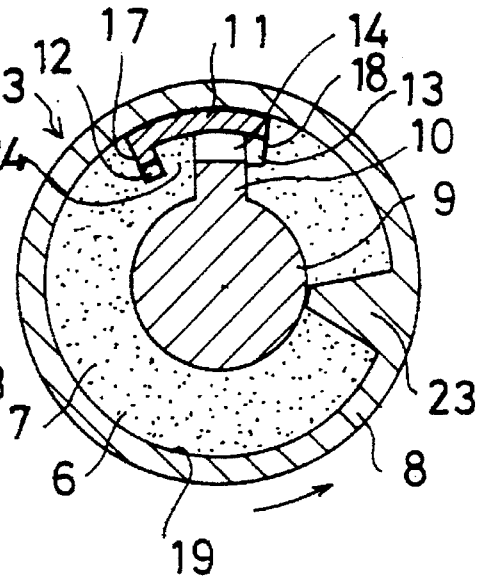
Figure 3C:
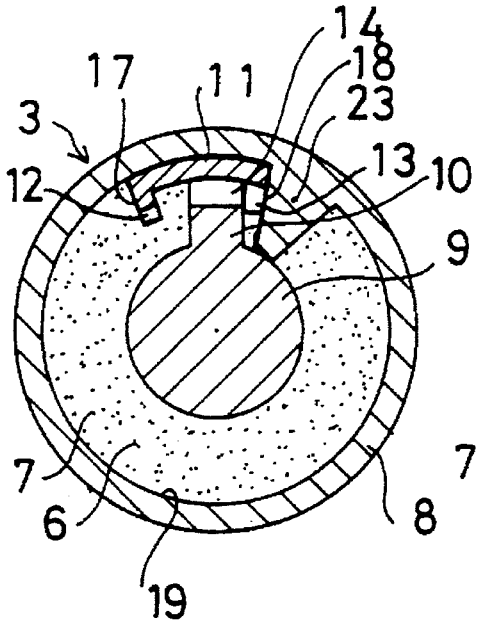
Figure 3D:
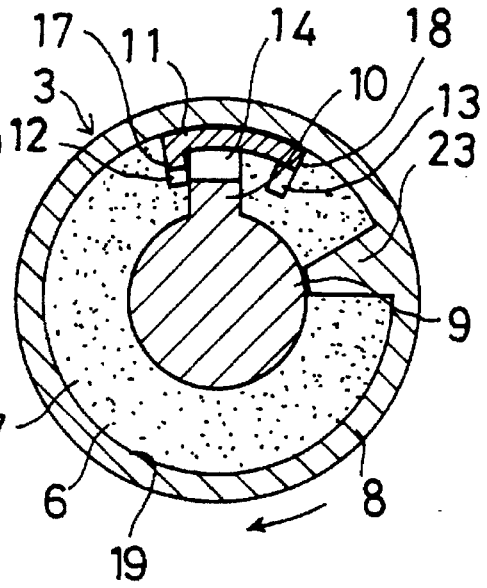

When the closed fall board 2 is opened and the casing 8 of the above-mentioned oil damper 3 starts to rotate from the condition as shown in FIG. 3A in the direction of an arrow, i.e., in the counterclockwise direction, the movable valve 11 rotates by being pushed by the viscous fluid 7 as a result of rotation of the stopper 23 and, as shown in FIG. 3B, the perpendicular wall 18 of movable valve 11 contacts the projecting portion 10. The viscous fluid 7, consequently, flows in the direction of the fluid passage 13→the passage 14→the space 24 between the perpendicular wall 17 and the projecting portion 10, and therefore the resistance is small. When, as shown in FIG. 3C, the fall board 2 rotates, from the fully open condition in which the stopper 23 abuts the projecting portion 10 via the movable valve 11, oppositely towards the direction of closing the fall board 2 and, consequently, the casing 8 starts to rotate in the direction of an arrow in FIG. 3D from the condition in FIG. 3C, i.e., in the clockwise direction, the perpendicular wall 17 of the movable valve 11 abuts the projecting portion 10 as shown in FIG. 3D. Because the viscous fluid 7 then flows through the small-area fluid passage 12, a very large resistance occurs.

I claim:

1. An apparatus, with an oil damper, for opening and closing a fall board on a main body of a musical keyboard instrument comprising:

an oil damper mounted on said fall board and connected to said main body for rotatably supporting said fall board for being opened and closed on said main body of said musical instrument;

said oil damper having a movable arcuate valve for damping rotation of said fall board on said main body only when said fall board is being rotated in a direction on said main body for closing said fall board wherein the oil damper comprises:

a casing having a hollow cylindrical chamber filled with a viscous fluid, said casing being closed at one axial end portion thereof and open at the other axial end portion, said casing having a radially inwardly projecting axially extending stopper extending along the inner wall of said cylindrical chamber;

a pivoting member rotatable in said casing and having a center shaft portion disposed inside said chamber and rotatable on about an axis extending between said closed axial end portion and said open other axial end portion of said casing, and a seal at the open end portion of said casing, said seal and said pivoting member forming a fluid tight seal in said open end portion of said casing, said shaft portion having a projecting portion extending axially and radially outwardly along a peripheral surface of said shaft in said casing;

said movable arcuate valve having spaced projecting portions extending radially inward and axially along a peripheral surface of said shaft, said projecting portions of said movable valve being engagable with opposite sides of said projecting portion of said shaft portions and contacting said projecting portion depending on the direction of rotation of said casing;

a fluid passage in each of said projecting portions of said movable valve and said projection portion of said shaft portion, said fluid passage in one of said projecting portions of said movable valve being smaller than said fluid passage in the other of said projecting portions so that the viscous resistance of fluid passing through said smaller fluid passage in said projecting portion of said valve is greater when said projecting portion of said shaft portion is rotated toward said smaller fluid passage to close said fall board on said main body of said musical instrument than when said projecting portion of said shaft portion is rotated in an opposite direction, said casing being fixed to said fall board and said pivoting member being attached to said musical instrument main body such that a high resistance occurs to the passing fluid when the fall board is rotated in the direction to close said fall board and a low resistance occurs when said fall board is rotated in the direction to open said fall board.

* * * * *